United States Patent [19]

Steinmetz

[11] Patent Number: 5,060,577

[45] Date of Patent: Oct. 29, 1991

[54] DIAPHRAGM ASSEMBLY FOR THE ENDS OF PASSENGER RAILROAD CARS COMPRISING ONE PIECE INTEGRALLY MOLDED URETHANE CHANNEL MEMBERS

[76] Inventor: Floyd Steinmetz, R. D. #4, Moscow, Pa. 18444

[21] Appl. No.: 450,609

[22] Filed: Dec. 13, 1989

[51] Int. Cl.[5] ..... B61D 17/22

[52] U.S. Cl. ..... 105/15; 105/18

[58] Field of Search ..... 105/8.1, 10, 15, 18

[56] References Cited

U.S. PATENT DOCUMENTS

| | | | |
|---|---|---|---|
| 1,078,757 | 11/1913 | Whitmore | 105/10 |
| 1,923,441 | 8/1933 | Kass et al. | 105/10 |
| 3,399,632 | 9/1968 | Dean | 105/15 |
| 3,410,226 | 11/1968 | Krupp | 105/10 |
| 3,486,464 | 12/1969 | Dean et al. | 105/8 |
| 3,996,859 | 12/1976 | Heisler et al. | 105/15 |
| 4,318,345 | 3/1982 | Kleim | 105/15 |
| 4,599,947 | 7/1986 | Keefer | 105/15 |
| 4,632,039 | 12/1986 | Küker et al. | 105/8.1 |
| 4,905,607 | 3/1990 | Wanneroy | 105/8.1 |

*Primary Examiner*—Robert J. Oberleitner
*Assistant Examiner*—S. Joseph Morano
*Attorney, Agent, or Firm*—John F. A. Earley; John F. A. Earley, III

[57] ABSTRACT

A diaphragm assembly for the ends of railroad passenger cars comprises a head section, a sill section, and a pair of spaced apart upright side sections which connect the ends of the head and sill sections together. Each section is made of a single cast of urethane and is a molded integral section. Each section includes a channel member which has a pair of legs separated at one end and connected together at the bottom of the legs by a base member having a face portion with a hard rubbing surface for rubbing against a similar rubbing surface of an abutting diaphragm assembly. Hard flanges are molded onto the separated ends of the legs for mounting the channel member onto the door frame of the railroad car, and, in the side and head sections, a series of spaced-apart posts extend inwardly from the base member between the legs for insertion into a guide channel on the door frame of the railroad car to prevent lateral movement of the channel member.

16 Claims, 4 Drawing Sheets

DIAPHRAGM ASSEMBLY FOR THE ENDS OF PASSENGER RAILROAD CARS COMPRISING ONE PIECE INTEGRALLY MOLDED URETHANE CHANNEL MEMBERS

BACKGROUND OF THE INVENTION

1. Field of the Invention

This invention relates to diaphragm assemblies for railroad cars, and more particularly concerns diaphragm assemblies for connecting together the ends of railroad passenger cars.

2. Description of the Prior Art

Conventional diaphragm assemblies for connecting the ends of passenger railroad cars are a sandwich of steel plates and foam materials and typically comprise a thick core or section of foam material of rubber or synthetic resin that provides a spring-like resilience to the diaphragm assembly, a thin cover over the foam material to protect it from damage, a metal mounting plate which is fixed to the inner end of the foam section for attaching it to the end of a railroad car, a metal channel which is fixed to the outer end of the foam section to maintain its shape and to provide a mounting surface for a rubbing strip, and a rubbing strip of low-friction material which is mounted on the metal channel to provide a contact surface that rubs against a similar contact surface of an abutting diaphragm assembly on an adjoining railroad car.

A problem with conventional prior art diaphragm assemblies is that it is costly to fabricate the different components from different materials and to assemble them together.

Another problem with the prior art diaphragm assemblies is that their foam core is subject to damage by vandalism or by flying stones. The foam material itself is easily damaged and must have a flexible cover to protect it. This cover must be thin enough to enable the foam material to flex, but the thinness of the cover makes it vulnerable to damage.

Yet another disadvantage of the prior art diaphragm assemblies is that they combine the cover, which may be a rubberized fabric, with metal parts. If the cover is made of rubber and the rubber is black, it cannot be colored easily. The metal must be painted and the painted surface is subject to scratches and may need to be repainted.

SUMMARY OF THE INVENTION

It is an object of this invention to provide a diaphragm assembly for passenger railroad cars which is economical to manufacture and which expands, contracts and moves in response to the changing positions of connected railroad passenger cars.

Another object of the invention is to provide a diaphragm assembly having integral diaphragm sections made from a single casting so as to eliminate the time and cost of assembling the unit from many parts.

It is a further object of this invention to provide a diaphragm assembly that is very durable and which requires little or no maintenance.

In accordance with these and other objects of the invention, there is shown a diaphragm assembly constructed in accordance with the invention which comprises a pair of spaced-apart upright side sections connected together at the top by a head section, and connected together at the bottom by a sill section.

Each diaphragm section of the diaphragm assembly is single-cast from urethane. Different portions of each single-cast diaphragm section have different characteristics, such as hardness, stiffness, and friction, and this enables the diaphragm sections to be made very economically in one integral part rather than requiring that various parts of various characteristics be assembled together, as in the conventional diaphragm assemblies. The diaphragm sections of this invention have a channel member with a pair of legs that are made of soft, flexible material so as to flex under compressive pressure. The legs are connected together by a base member which is made of hard material for rubbing against the rubbing surface of an abutting diaphragm assembly, and the separated ends of the legs have hard flanges molded thereon for mounting on the door frame of a passenger railroad car. To maintain the alignment of the side sections and the head section of the diaphragm assembly, a series of spaced-apart posts are molded into the channel member and extend between the legs into a guide channel formed by sheet metal angles mounted on the door frame of the railroad car to prevent lateral movement of the diaphragm section.

The diaphragm assembly of the present invention is very durable and maintenance-free because it is made of urethane, which, by its nature, is very tough and tear-resistant. The urethane parts may be made any color with the color pigments permeating the entire urethane member completely and thoroughly.

DETAILED DESCRIPTION

Figure 1:
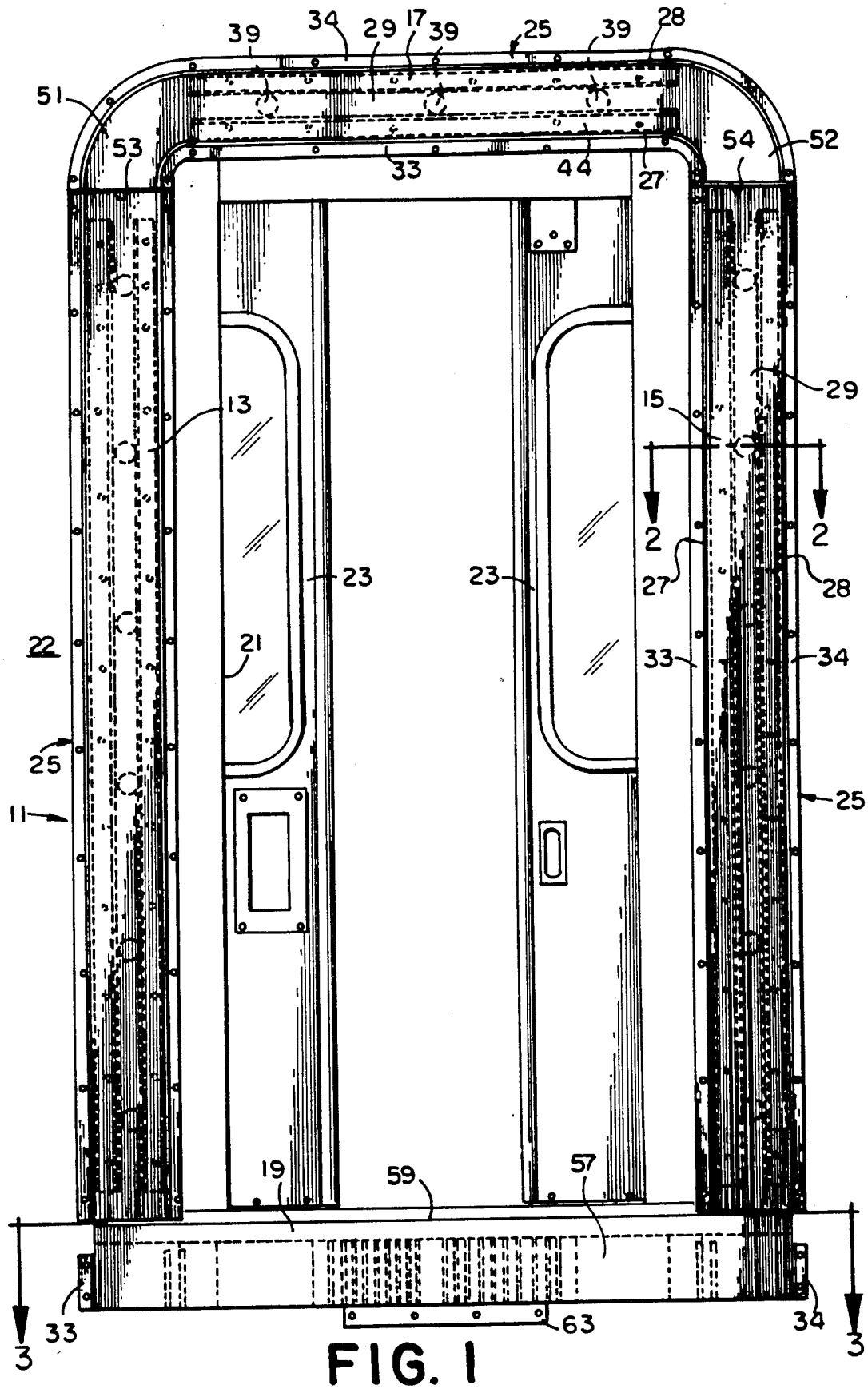
FIG. 1 is an end view in elevation of a diaphragm assembly constructed in accordance with the invention as it would appear when mounted on the end of a railroad passenger car.
Figure 3:
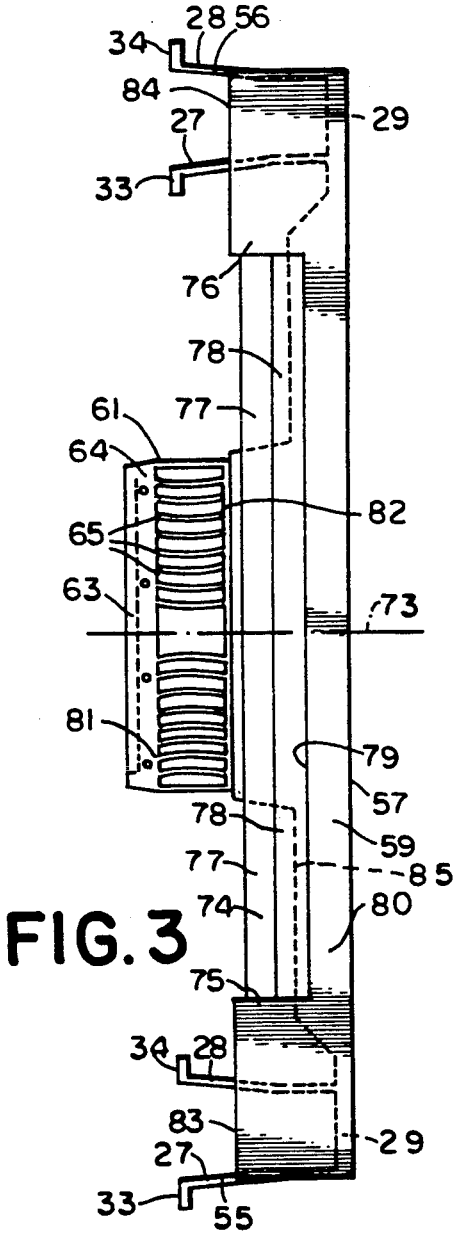
FIG. 3 is a view in top plan of the horizontal sill section of the diaphragm assembly taken as indicated by the lines and arrows 3—3 which appear in FIG. 1.

Turning now to the drawings, there is shown a diaphragm assembly 11 which comprises a pair of spaced-apart upright side sections 13, 15 connected together at the top by a head or cap section 17, and connected together at the bottom by a sill section 19. Diaphragm assembly 11 is mounted on the door frame 21 of a railroad passenger car having a door 23.

Figure 2:
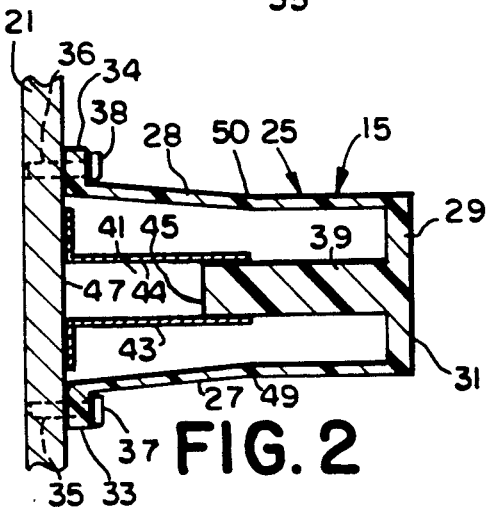
FIG. 2 is a view in horizontal section of a side section of the diaphragm assembly taken as indicated by the lines and arrows 2—2 which appear in FIG. 1 and shows the structure of a side section.

The structure of side sections 13 and 15 is the same, and a horizontal cross section of that structure is shown in FIG. 2 and is taken as indicated by the lines and arrows 2—2 which appear in FIG. 1.

Side section 15 comprises a channel member 25 which has a pair of legs 27, 28 connected together at the bottom of the legs 27, 28 by a face plate or base member 29 that provides a contact or rubbing surface 31 for contacting or rubbing against a similar contact surface on an abutting diaphragm assembly of an adjoining railroad car.

The separated ends of legs 27, 28 are provided with flanges 33, 34 having holes 35, 36, and the flanges 33, 34 of legs 27, 28 are mounted on the door frame 21 of the railroad car 22 by bolts 37, 38 which extend through the flange holes 35, 36.

A series of spaced-apart posts 39 extend inwardly from the center line of base member 29 into a guide channel 41 formed by a pair of sheet metal angles 43, 44 which are mounted on railroad car door frame 21.

The legs 27, 28 are about 10 inches long, and the posts 39 are about 7 inches long. The guide channel 41 prevents side to side, or lateral, movement of the posts 39, so that when the diaphragm assembly 11 is being compressed by an abutting diaphragm assembly on an adjoining railroad car 22, the posts prevent diaphragm assembly 11 from being moved laterally out of alignment.

Figure 5:
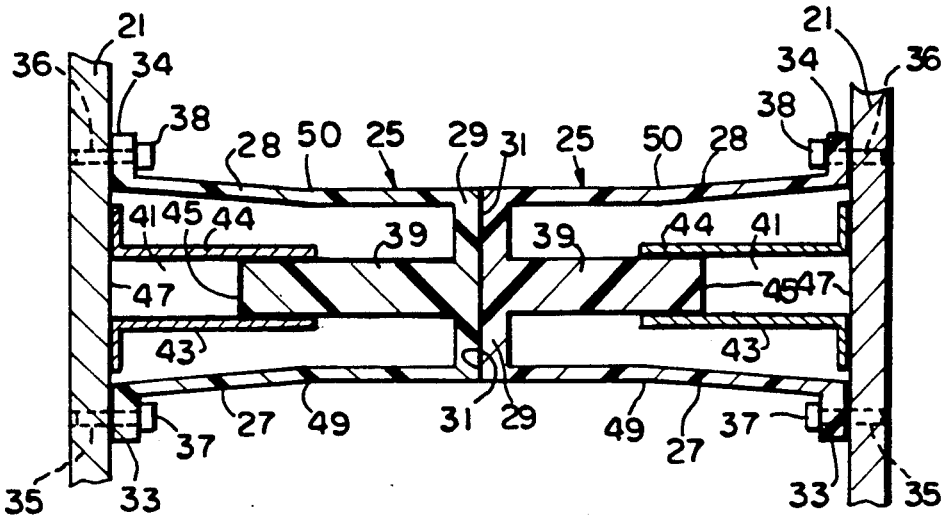
FIG. 5 is a partial view in horizontal section of two abutting diaphragm sections of two diaphragm assemblies with the legs of the diaphragm sections in extended position.
Figure 6:
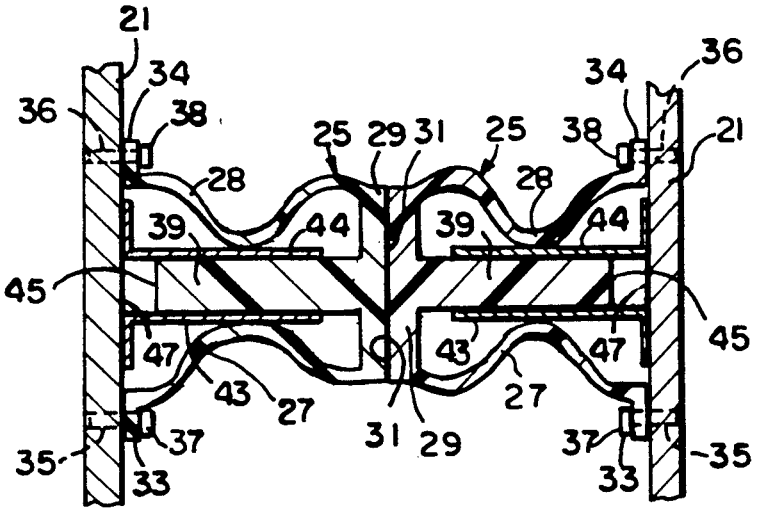
FIG. 6 is a view in section similar to that of FIG. 5 but with the legs of the diaphragm sections in compressed or flexed position.

Accordingly, diaphragm base member 29 may be moved back and forth in a horizontal direction as the base member 29 moves from a relaxed position, as shown in FIG. 2 and 5 with its legs 27, 28 extended, to a compressed position with the legs 27, 28 flexed or bowed inwardly as shown in FIG. 6.

FIG. 5 shows a view in horizontal cross section of a pair of side sections of diaphragm assemblies 11 of adjoining railroad cars and shows the legs 27, 28 in extended position with the posts 39 having their end surfaces 45 positioned about 3 inches from the surface 47 of door frames 21.

FIG. 6 shows a partial view in horizontal cross section of the side sections of abutting diaphragm assemblies 11 of adjacent railroad cars 22, and shows the legs 27, 28 in their compressed condition with the legs 27, 28 bent inwardly so as to not interfere with the passageway between the railroad cars.

Figure 4:
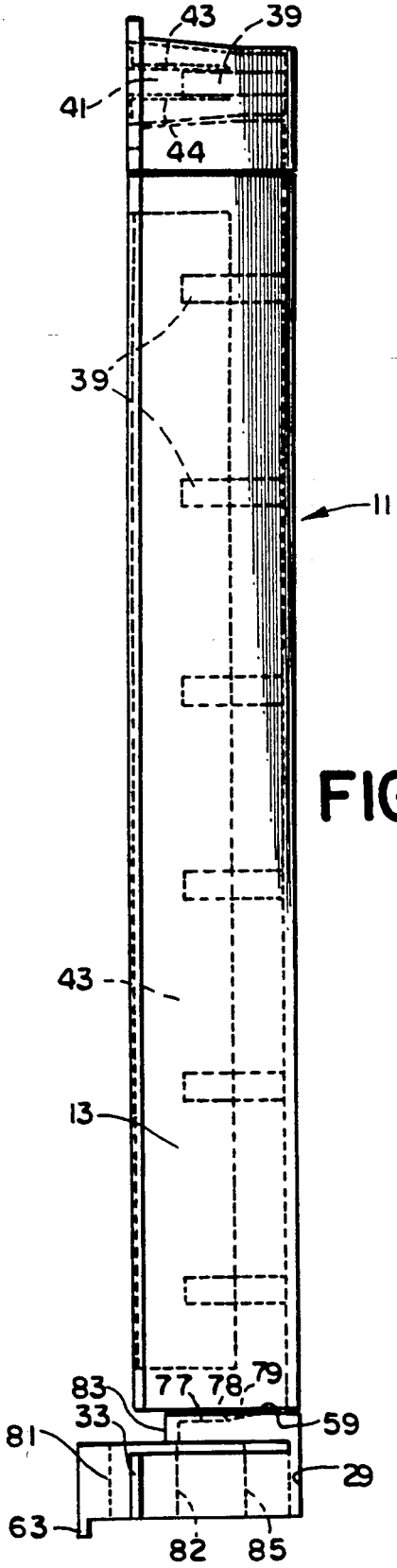
FIG. 4 is a view in side elevation of a diaphragm assembly looking from the left side of FIG. 1.

Posts 39 are molded (FIG. 4) into the base member 29 of side sections 13, 15 at about 12 inch intervals.

The legs 27, 28 are pre-set so as to bend inwardly when compressed by providing them during casting with an inward bend in their extended position. Legs 27, 28 extend at right angles from base member 29 until they reach a bend line 49, 50 (FIGS. 2–5), after which the legs flare outwardly until they reach the flanges 37, 38.

Cap or head section 17 (FIG. 1) is provided with rounded shoulders 51, 52 at its ends which are extensions of its channel member 25 and which have shoulder ends 53, 54 which abut against the top surface of channel members 25 of side sections 13, 15. Between the shoulders 51 and 52, the structure of head section 17 is the same as the structure of side sections 13 and 15 and includes channel member 25, legs 27, 28 joined by base member 29, flanges 33, 34, and posts 39 mounted on base member 29 and extending toward door frame 21 with about a 3 inch space between the end 45 of posts 39 and the surface 47 of door frame 21.

The operation of head section 17 is the same as the operation of the side sections 13, 15.

Just as with side sections 13, 15, when the head section 17 is compressed, the legs 27, 28 flex inwardly toward each other to absorb the compressive force. However, with head section 17, the posts 39 and the guide channel 41 cooperate to keep head section 17 in horizontal alignment, rather than in vertical alignment as with side sections 13, 15.

Sill section 19 (FIG. 3) comprises two short side members 55, 56, with short side member 55 being mounted below side member 13 and short side member 56 being mounted below side member 15. Short side members 55, 56 have legs 27, 28 joined by a base member 29 and the legs 27, 28 include flanges 33, 34 which are connected to the surface 47 of door frame 21 by bolts. A sill face plate member 57 connects together the base members 29 of short side members 55, 56. A top plate member 59 is molded on top of short side members 55, 56 and extends between them and is horizontally positioned for train passengers to step on when they walk through the passageway between adjoining railroad cars.

Sill section 19 further includes auxiliary compression member 61 formed in sill section 19 behind sill face plate member 57 for assisting in the absorbing of the force from an adjoining diaphragm assembly 11 of an adjacent railroad car 22.

Figure 7:
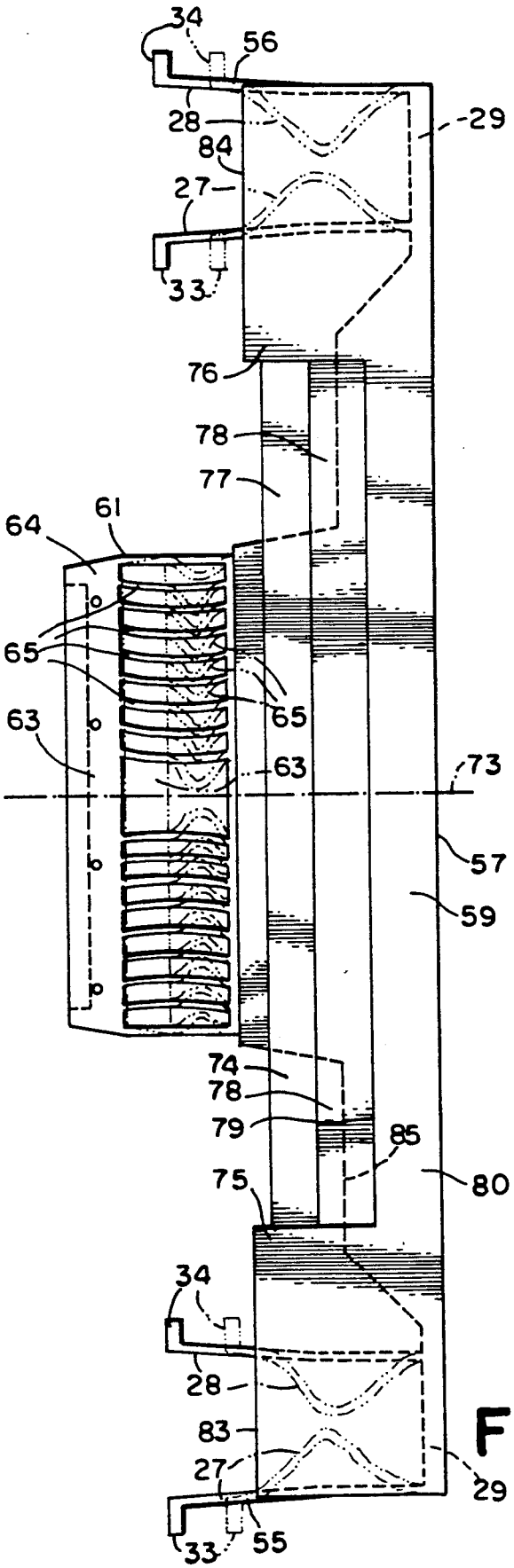
FIG. 7 is a top plan view of the sill section similar to FIG. 3 but with the sill section under compression and shows the channel legs flexed toward each other and the auxiliary ribs flexed toward their center line.

Auxiliary compression member 61 includes a vertical connection plate member 63, which is bolted to the floor of the railroad car to connect with the car floor, and a horizontal rib plate 64, having a series of flexible ribs 65 which extend between connection plate member 63 and sill face plate member 57. When a compressive force is applied to sill section 19, the ribs 65 bend inwardly toward a center line 73 as is shown in dot-dash lines in FIG. 7 to absorb the compressive force.

Top plate member 59 has a top recess 74 defined by right and left walls 75, 76 in the top plate member 59, and by bottom wall 77 which has a flared portion 78 that flares upwardly to the top surface 80 of top plate member 59 at front edge 79 of recess 74. Recess 74 receives a plate which is hinged to the floor of the railroad car and on which the passengers tread when walking between cars.

The inner edges 81 of ribs 65 are in alignment, as are the outer edges 82. The rear faces 83, 84 of top plate member 59 form a plane between themselves. Sill face plate member 57 is thicker in the middle than it is at its ends 29, as is shown by inner wall 85.

In operation, diaphragm assemblies 11 are mounted on adjoining ends of two railroad cars, with the contact faces or surfaces 31 (FIG. 5) in contact with each other. Coupling of the railroad cars together causes each diaphragm assembly to compress approximately 2 inches and exert compressive forces against the contact faces 31 of the head 17 and side 13, 15 sections and sill face plate member 57. The compressive forces move the diaphragm assemblies 11 to a compressed position (FIG. 6) where legs 27, 28 and ribs 65 are flexed or bent.

The legs 27, 28 bend inwardly so as to not intrude on the passageway space between the railroad cars. The posts 39 and the guide channel 41 formed by sheet metal angles 43, 44 confine the lateral movement of the channel members 25 and do not permit lateral movement.

The diaphragm assembly 11 is preferably 10 inches deep and the legs 27, 28 flex inwardly when compressed.

Diaphragm assembly 11 has the same mounting width and the same rubbing contact width as the conventional diaphragm assemblies it replaces.

Diaphragm assembly 11 comprises four separate sections which are joined together to form the unit: the cap or head section 17, the sill section 19, and the side sections 13, 15. Accordingly, if one section suffers damage, only the damaged section needs to be replaced, not all four sections.

The sill section 19 is more complex than head section 17 and side sections 13, 15, because the sill section 19 must fulfill many objectives involving existing car structure and passenger walk path. The compressing of sill section 19 is accomplished by two short side members 55, 56 and by 18 thin flexible ribs 65 which are disposed in the central area of sill section 19. All of the diaphragm assembly sections 13, 15, 17 and 19 include contact or rubbing faces made of hard urethane. Leg flanges 33, 34 are made of hard urethane for mounting the diaphragm assembly sections 13, 15, 17 and 19 onto the door frame 21 of the railroad car, and legs 27, 28 are made of soft urethane for flexing when compressed by the force from an adjacent railroad car. These materials of different hardness are cast one on the other to provide a solid, single cast, chemically bonded part. For example, a liquid mix of hard urethane is poured into a mold to form the base member. Next, a liquid mixed of soft urethane is poured into the mold above the hard urethane liquid before it has set to form the legs and posts, then a liquid mix of hard urethane is poured into the mold on top of the soft urethane liquid before the liquid in the mold has set to form the hard flanges, and then the liquid urethane in the mold is allowed to set. The sections 13, 15, 17 and 19 are single cast parts with the leg flanges 33, 34 being hard, the legs 27, 28 and posts 39 being resilient and flexible, and the base members 29 being hard, to provide a hard bearing or contact surfaces 31.

Diaphragm assembly 11 uses thick, soft urethane legs 27, 28 to do the flexing, instead of using a foam core of the conventional prior art diaphragm assemblies. Urethane legs 27, 28 are by nature tough and wear resistant. Diaphragm assembly 11 requires no maintenance. Also, the metal parts, the sheet metal angles 33, 34, are hidden from view.

The method of this invention of enclosing the vestibule space between adjoining ends of two railroad passenger cars comprises the steps of providing a first diaphragm assembly for the end of a railroad passenger car including a head section 17, a sill section 19, and a pair of spaced-apart upright side sections 13, 15 which connect the ends of the head 17 and sill 19 sections together, each section being made of a single cast of urethane, with each side section 13, 15 comprising a channel member 25 having a pair of legs 27, 28 separated at one end and connected together at the bottom of the legs 27, 28 by a base member 29 having a face portion, a hard rubbing surface 31 on the face portion of the base member 29 for rubbing against a similar rubbing surface of an abutting diaphragm assembly, hard flanges 33, 34 molded on the separated ends of the legs 27, 28 for mounting the channel member 25 onto the door frame 21 of a railroad passenger car 22, and alignment means, posts 39 molded into the channel member 25 for holding the channel member 25 in longitudinal alignment and preventing lateral movement of the channel member 25, the legs 27, 28 being flexible and resilient enough to bend when subjected to compressive forces from an abutting diaphragm assembly, providing a second diaphragm assembly for the end of a railroad passenger car including a head section 17, a sill section 19, and a pair of spaced-apart side sections 13, 15 connecting the ends of the head 17 and sill 19 sections together, each section being made of a single cast of urethane, each side section 13, 15 comprising a channel member 25 having a pair of legs 27, 28 separated at one end and connected together at the bottom of the legs by a base member 29 having a face portion, a hard rubbing surface 31 on the face portion of the base member 29 for rubbing against a similar rubbing surface of an abutting diaphragm assembly, hard flanges 33, 34 molded onto the separated ends of the legs 27, 28 for mounting the channel member 25 onto the door frame 21 of a railroad car 22, and alignment means, posts 39 molded into the channel member 25 for holding the channel member 25 in longitudinal alignment and preventing lateral movement of the channel member, the legs 27, 28 being flexible and resilient enough to bend when subjected to compressive forces from an abutting diaphragm assembly, mounting the first diaphragm assembly onto the door frame 21 of a first railroad passenger car 22, mounting the second diaphragm assembly onto a door frame of a second railroad passenger car, connecting the ends of the first and second railroad passenger cars together so that the hard rubbing surfaces 31, 31 of the diaphragm assemblies rub against each other, compressing and extending the abutting diaphragm assembly in response to compression forces exerted between the diaphragm assemblies as the adjacent railroad cars shift and move and exert different pressures on different locations of the diaphragm assemblies, and keeping the rubbing surfaces 31, 31 of the diaphragm assemblies in contact with each other to keep the vestibule passageway of the passenger railroad cars enclosed by the diaphragm assemblies.

Diaphragm assemblies 11 are so dimensioned that they match with the dimensions of conventional diaphragm assemblies so that if a diaphragm assembly 11 is mounted on the end of one railway passenger car, and a conventional diaphragm assembly is mounted on the end of the adjacent railway passenger car, the two different diaphragm assemblies match just as if two conventional diaphragm assemblies were abutting each other, or two diaphragm assemblies 11 were abutting each other.

In addition to dimensional matching, the spring rate of collapsing diaphragm assemblies 11 matches the spring rate of collapsing of conventional diaphragm assemblies. If the spring rate of diaphragm assembly 11 were too low or soft, when a diaphragm assembly 11 abutted a conventional diaphragm assembly, all or most of the flexing would be done by diaphragm assembly 11. On the other hand, if the spring rate of flexing of a diaphragm 11 were too high or hard, when a diaphragm assembly 11 abutted a conventional diaphragm assembly, all or most of the flexing would be done by the conventional diaphragm assembly. In order to avoid this problem, the spring rate of flexing or collapsing of diaphragm assemblies 11 are matched to the spring rate of collapsing or flexing of conventional diaphragm assemblies. The spring rates of diaphragm assemblies 11 are controlled by controlling the hardness of the channel member 25 and especially the hardness of legs 27, 28, or by controlling the thickness of the channel members 25 and especially the thickness of legs 27, 28.

I claim:

1. A diaphragm assembly for the ends of railroad passenger cars, comprising an integral head section, an integral sill section, a pair of spaced-apart upright integral side sections connecting the ends of the head and sill sections together, each section being made of a single case of synthetic resin, each side section comprising a channel member having a pair of legs separated at one end and connected together at the bottom of the legs by a channel base member having a face portion, a hard rubbing surface on the face portion of the channel base member for rubbing against a similar rubbing surface of an abutting diaphragm assembly, hard flanges molded onto the separated ends of the legs for mounting the channel member onto the door frame of a railroad car, and a series of alignment means molded into the channel member for holding the channel member in longitudinal alignment and preventing lateral movement of the channel member, said legs being made of a material which is flexible and resilient enough to bend when subjected to compressive force from an abutting diaphragm assembly.

2. The diaphragm assembly of claim 1, said alignment means comprising a series of spaced-apart posts extending inwardly from the base member between the legs for insertion into a guide channel mounted on the door frame of a railroad car to prevent lateral movement of the channel member, with the end of the posts being normally spaced away from the door frame of the railroad car when the channel is in its non-compressed condition.

3. The diaphragm assembly of claim 1, the head section comprising a channel member having pair of legs connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, alignment means molded into the channel member for holding the channel member in longitudinal alignment and preventing lateral movement of the channel member, said legs being flexible and resilient enough to bend when subjected to compressive force from an abutting diaphragm assembly, the head section having rounded shoulders molded at each end which are extensions of the channel member and have shoulder ends for abutting against the top ends of the channel members of the side sections.

4. The diaphragm assembly of claim 1, the sill section comprising two spaced-apart short side members, each short side member comprising a channel member having a pair of legs connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, said legs being flexible and resilient enough to bend when subjected to compressive force from an abutting diaphragm assembly, a sill face plate member connecting together the short side members, a top plate member molded on top of the short side members and extending between them, said top plate member being horizontally positioned for train passengers to step on when they walk through the passageway between railroad cars, and an auxiliary compression means formed in the sill section below the top plate member for assisting in absorbing compressive force from an abutting diaphragm assembly from an adjacent railroad car.

5. A diaphragm assembly for the ends of railroad passenger cars, comprising a head section, a sill section, a pair of spaced-apart upright side sections connecting the ends of the head and sill sections together, each section being made of a single cast of synthetic resin, each side section comprising a channel member having a pair of legs separated at one end and connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, and alignment means molded into the channel member for holding the channel member in longitudinal alignment and preventing lateral movement of the channel member, said legs being flexible and resilient enough to bend when subjected to compressive force from an abutting diaphragm assembly, said legs extending at right angles from the base member to a break line and flaring outwardly therefrom so that the legs flex inwardly toward themselves when the diaphragm assembly is subjected to compression force from an abutting diaphragm assembly on an adjacent railroad passenger car.

6. A diaphragm assembly for the ends of railroad passenger cars, comprising a head section, a sill section, a pair of spaced-apart upright side sections connecting the ends of the head and sill sections together, each section being made of a single cast of synthetic resin, each side section comprising a channel member having a pair of legs separated at one end and connected together at the bottom of the legs by a base member having a face portion, a hard rubbing surface on the face portion of the base member for rubbing against a similar rubbing surface of an abutting diaphragm assembly, a hard flanges molded onto the separated ends of the legs for mounting the channel member onto the door frame of a railroad car, and alignment means molded into the channel member for holding the channel member in longitudinal alignment and preventing lateral movement of the channel member, said legs being flexible and resilient enough to bend when subjected to compressive force from an abutting diaphragm assembly, the sill section comprising two spaced-apart short side members, each short side member comprising a channel member having a pair of legs connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, said legs being flexible and resilient enough to bend when subjected to compressive force from an abutting diaphragm assembly, a sill face plate member connecting together the short side members, a top plate member molded on top of the short side members and extending between them, said top plate member being horizontally positioned for train passengers to step on when they walk through the passageway between railroad cars, and an auxiliary compression means formed in the sill section below the top plate member for assisting in absorbing compressive force from an abutting diaphragm assembly from an adjacent railroad car, said auxiliary compression means comprising a connection plate member molded in the sill section for mounting on the door frame of the railroad car, a series of flexible ribs extending between the connection plate member and the sill face plate member, the ribs being formed of a flexible material so that when a force is exerted against the contact surface of the sill face plate member the ribs bend to absorb the force.

7. The diaphragm assembly of claim 6, wherein the flexible material of the ribs is urethane.

8. A diaphragm assembly for the ends of railroad passenger cars, comprising a head section, a sill section, a pair of spaced-apart upright side sections connecting the ends of the head and sill sections together, each section being made of a single cast of synthetic resin, each side section comprising a channel member having a pair of legs connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, alignment means molded into the channel member for holding the channel member in longitudinal alignment and preventing lateral movement of the channel member, said legs being flexible and resilient enough to bend when subjected to compressive force from an abutting diaphragm assembly, said alignment means comprising a series of spaced-apart posts extending inwardly from the base member between the legs for insertion into a guide channel on the door frame of a railroad car to prevent lateral movement of the channel member, with the end of the posts being normally spaced away from the door frame of the railroad car, and being in contact with the door frame when the channel member is flexed under compression forces, said legs extending at right angles from the base member to a break line and flaring outwardly therefrom so that the legs flex inwardly toward themselves when the diaphragm assembly is subjected to compression force from an abutting diaphragm assembly on an adjacent railroad passenger car, the head section comprising a channel member having pair of legs connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, alignment means molded into the channel member for holding the channel member in longitudinal alignment and preventing lateral movement of the channel member, said legs being flexible and resilient enough to bend when subjected to compressive force from an abutting diaphragm assembly, the head section having rounded shoulders molded at each end which are extensions of the channel member and have shoulder ends for abutting against the top ends of the channel members of the side sections, the sill section comprising two spaced-apart short side members, each short side member comprising a channel member having a pair of legs connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, said legs being flexible and resilient enough to bend when subjected to compressive force from an abutting diaphragm assembly, a sill face plate member connecting together the short side members, a top plate member molded on top of the short side members and extending between them, said top plate member being horizontally positioned for train passengers to step on when they walk through the passageway between railroad cars, and an auxiliary compression means formed in the sill section below the top plate member for assisting in absorbing compressive force from an abutting diaphragm assembly from an adjacent railroad car, said auxiliary compression means comprising a connection plate member molded in the sill section for mounting on the door frame of the railroad car, a series of flexible ribs extending between the connection plate member and the sill face plate member, the ribs being formed of a flexible material so that when a force is exerted against the contact surface of the sill face plate member the ribs bend to absorb the force, and wherein the flexible material of the ribs is urethane.

9. A molded integral diaphragm section for a diaphragm assembly for the ends of railroad passenger cars, comprising a channel member having a pair of legs separated at one end and connected together at the bottom of the legs by a base member having a face portion, a hard rubbing surface on the face portion of the base member for rubbing against a similar rubbing surface of an abutting diaphragm assembly, hard flanges molded into the separated ends of the legs for mounting the channel member onto the door frame of a railroad car, and a series of alignment means molded into the channel member for holding the channel member in longitudinal alignment and preventing lateral movement of the channel member comprising a series of spaced apart posts extending inwardly from the base member between the legs for insertion into a guide channel on the door frame of the railroad car, said legs being flexible and resilient enough to bend when subjected to compressive force from an abutting diaphragm assembly, the section being made of a single cast of synthetic resin, 10. A molded integral head section for a diaphragm assembly for the ends of railroad passenger cars, comprising a channel member having pair of legs separated at one end and connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, a series of alignment means molded into the channel member for holding the channel member in longitudinal alignment and preventing lateral movement of the channel member comprising a series of spaced-apart posts extending inwardly from the base member between the legs for insertion into a guide channel on the door frame of the railroad car, said legs being flexible and resilient enough to bend when subjected to compressive force from an abutting diaphragm assembly, and rounded shoulders molded at each end of the channel member which are extensions of the channel member and have shoulder ends for abutting against the top ends of the channel members of the side sections of the diaphragm assembly, the head section being made of a single cast of synthetic resin.

11. A molded integral sill section for a diaphragm assembly for the ends of railroad passenger cars, comprising two spaced-apart short side members, each short side member comprising a channel member having a pair of legs separated at one end and connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, said legs being flexible and resilient enough to bend when subjected to compressive force from an abutting diaphragm assembly, a sill face plate member connecting together the short side members, a top plate member molded on top of the short side members and extending between them, said top plate member being horizontally positioned for train passengers to step on when they walk through the passageway between railroad cars, and an auxiliary compression means formed in the sill section behind the sill face plate member for assisting in absorbing compressive force from an abutting diaphragm assembly from an adjacent railroad car, said sill section being made of a single cast of a synthetic resin.

12. A molded integral sill section for a diaphragm assembly for the ends of railroad passenger cars, comprising two spaced-apart short side members, each short side member comprising a channel member having a pair of legs separated at one end and connected together at the bottom of the legs by a base member having a face portion, a hard rubbing surface on the face portion of the base member for rubbing against a similar rubbing surface of an abutting diaphragm assembly, a hard flanges molded onto the separated ends of the legs for mounting the channel member onto the door frame of a railroad car, said legs being flexible and resilient enough to bend when subjected to compressive force from an abutting diaphragm assembly, a sill face plate member connecting together the short side members, a top plate member molded on top of the short side members and extending between them, said top plate member being horizontally positioned for train passengers to step on when they walk through the passageway between railroad cars, and an auxiliary compression means formed in the sill section behind the sill face plate member for assisting in absorbing compressive force from an abutting diaphragm assembly from an adjacent railroad car, said sill section being made of a single cast of a synthetic resin, said auxiliary compression means comprising a connection plate member molded in the sill section for mounting on the floor of the railroad a series of flexible ribs extending between the connection plate member and the sill face plate member, the ribs being formed of a flexible material so that when a force is exerted against the contact surface of the sill face plate member the ribs bend to absorb the force.

13. The diaphragm section of claim 12, wherein the flexible material of the ribs is urethane, and said ribs are pre-set at a bend line to bend toward the centerline of the auxiliary compression means.

14. A method of enclosing the vestibule space between adjoining ends of two railroad passenger cars with a diaphragm assembly, comprising providing a first diaphragm assembly for the end of a railroad passenger car including a head section, a sill section, and a pair of spaced-apart upright side sections connecting the ends of the head and sill sections together, each section being made of a single cast of urethane, each side section comprising a channel member having a pair of legs separated at one end and connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, and alignment means molded into the channel member for holding the channel member in longitudinal alignment and preventing lateral movement of the channel member, said legs being flexible and resilient enough to bend when subjected to compressive forces from an abutting diaphragm assembly, providing a second diaphragm assembly for the end of a railroad passenger car including a head section, a sill section, and a pair of spaced-apart upright side sections connecting the ends of the head and sill sections together, each section being made of a single cast of urethane, each side section comprising a channel member having a pair of legs separated at one end and connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, and alignment means molded into the channel member for holding the channel member in longitudinal alignment and preventing lateral movement of the channel member, said legs being flexible and resilient enough to bend when subjected to compressive forces from an abutting diaphragm assembly, mounting the first diaphragm assembly onto a door frame of a first railroad passenger car, mounting the second diaphragm assembly onto a door frame of a second railroad passenger car, connecting the ends of the first and second railroad passenger cars together so that the hard rubbing surfaces of the first and second diaphragm assemblies rub against each other, compressing and extending the abutting diaphragm assemblies in response to compression forces exerted between the diaphragm assemblies as the adjacent railroad cars shift and move and exert different pressures on different locations of the diaphragm assemblies, and keeping the rubbing surfaces of the diaphragm assemblies in contact with each other to keep the vestibule passageway of the passenger railroad cars enclosed by the diaphragm assemblies.

15. A diaphragm assembly made in accordance with the method of claim 14.

16. A diaphragm assembly for the ends of railroad passenger cars, comprising a head section, a sill section, a pair of spaced-apart upright side sections connecting the ends of the head and sill sections together, each section being made of a single cast of synthetic resin, each side section comprising a channel member having a pair of legs separated at one end and connected together at the bottom of the legs by a base member having a face portion, a hard rubbing surface on the face portion of the base member for rubbing against a similar rubbing surface of an abutting diaphragm assembly, hard flanges molded onto the separated ends of the legs for mounting the channel member onto the door frame of a railroad car, and alignment means molded into the channel member for holding the channel member in longitudinal alignment and preventing lateral movement of the channel member, said legs being flexible and resilient enough to bend when subjected to compressive force from an abutting diaphragm assembly, a second diaphragm assembly for the end of an adjacent passenger railroad car for abutting against the first said diaphragm assembly, said second diaphragm assembly comprising a sandwich of steel plates and foam material including a thick core of foam material that provides spring-like resilience to the second diaphragm assembly, a metal mounting plate which is affixed to the inner end of the foam section for attaching it to the end of a railroad car, a metal channel which is affixed to the outer end of the foam section to maintain its shape and to provide a mounting surface for a rubbing strip, a rubbing strip of low-friction material which is mounted on the metal channel to provide a contact surface that rubs against a similar contact surface of the abutting first said diaphragm assembly on the adjoining railroad car, the dimensions of the abutting diaphragm assembly being matched, and the spring rate of flexing or collapsing of the abutting diaphragm assemblies being matched as by controlling the hardness and thickness of the channel member and its legs.

* * * * *